US011241697B2

(12) United States Patent
Bennington et al.

(10) Patent No.: US 11,241,697 B2
(45) Date of Patent: Feb. 8, 2022

(54) CLASSIFIER APPARATUS, SYSTEMS AND METHODS

(71) Applicant: Superior Industries, Inc., Morris, MN (US)

(72) Inventors: John Bennington, Indianola, IA (US); Frank Squires, Columbus, NE (US)

(73) Assignee: Superior Industries, Inc., Morris, MN (US)

( * ) Notice: Subject to any disclaimer, the term of this patent is extended or adjusted under 35 U.S.C. 154(b) by 77 days.

(21) Appl. No.: 16/422,460

(22) Filed: May 24, 2019

(65) Prior Publication Data

US 2019/0358644 A1 Nov. 28, 2019

Related U.S. Application Data

(60) Provisional application No. 62/676,517, filed on May 25, 2018.

(51) Int. Cl.
*B03B 13/00* (2006.01)
*B03B 11/00* (2006.01)

(52) U.S. Cl.
CPC ..... *B03B 13/00* (2013.01); *B03B 11/00* (2013.01)

(58) Field of Classification Search
CPC ..... B03B 13/00; B03B 11/00
See application file for complete search history.

(56) References Cited

U.S. PATENT DOCUMENTS 3,114,479 A 12/1963 Keeney
3,129,849 A 4/1964 Cochran
3,160,321 A 12/1964 Cochran
3,913,788 A 10/1975 McCauley
4,199,080 A 4/1980 Keeney
4,667,887 A * 5/1987 Kawaguchi ..... B02C 25/00 241/20
5,818,732 A 10/1998 Vanderwilt
6,311,847 B1 * 11/2001 Soldwish-Zoole ..... B01F 13/1002 209/156
6,708,952 B2 3/2004 Brennecke et al.
6,796,432 B2 9/2004 Soldwish-Zoole et al.
6,871,757 B2 3/2005 Bennington et al.
2003/0173775 A1 9/2003 Brennecke et al.

FOREIGN PATENT DOCUMENTS

DE 3508458.8 C2 2/1987
EP 0095293 A2 * 11/1983 ..... B03B 13/00
EP 2396097 A1 12/2011

OTHER PUBLICATIONS

"Classifier with Aggrespec III System", Operator's and Maintenance Manual, Superior Industries, Jun. 2016, 41 pages.

* cited by examiner

*Primary Examiner* — Charles A Fox
*Assistant Examiner* — Jessica L Burkman
(74) *Attorney, Agent, or Firm* — Todd R. Fronek; Larkin Hoffman Daly & Lindgren, Ltd.

(57) ABSTRACT

Classifying tanks, related systems and methods of operating the same are described. Some classifying tank embodiments facilitate the use of a control system and methods to perform one or more of the following tracking the product discharged, performing optimization routines, and determining new settings for a plurality of stations of the classifying tank.

19 Claims, 7 Drawing Sheets

CLASSIFIER APPARATUS, SYSTEMS AND METHODS

BACKGROUND

Classifying apparatus and systems such as classifying tanks are used to classify material such as aggregate material. In a classifying tank, density of material varies across a plurality of stations from which material is selectively released by a valve. For example, in some examples the material is introduced with an initial horizontal velocity to an inlet end of the tank, causing denser material to be deposited at the inlet end and less dense material to be deposited at the end opposite the inlet end.

DESCRIPTION

Figure 1:
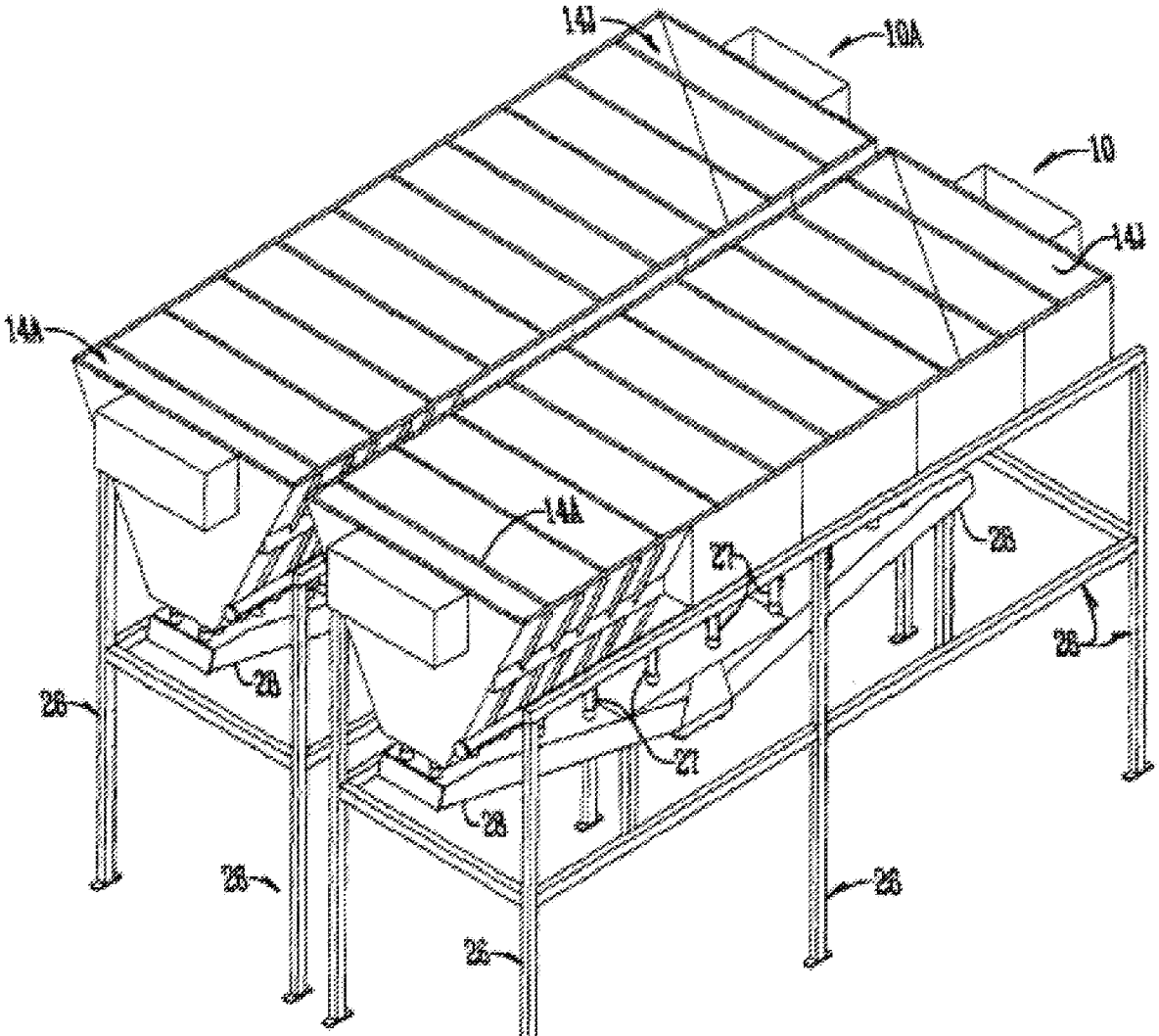
FIG. 1 is a perspective view of an embodiment of a classification tank.
Figure 2:
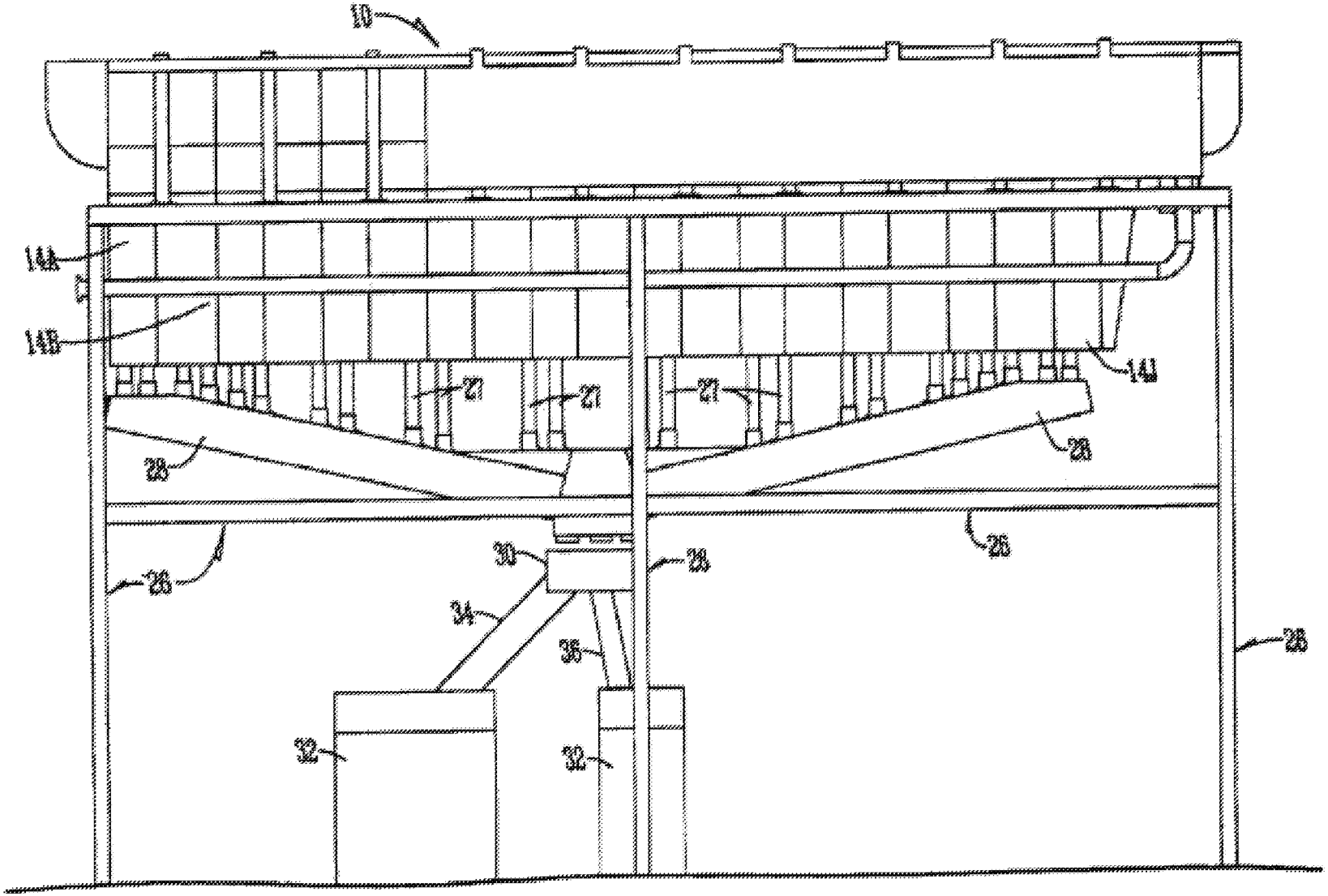
FIG. 2 is a front elevation view of the classification tank of FIG. 1.
Figure 3:
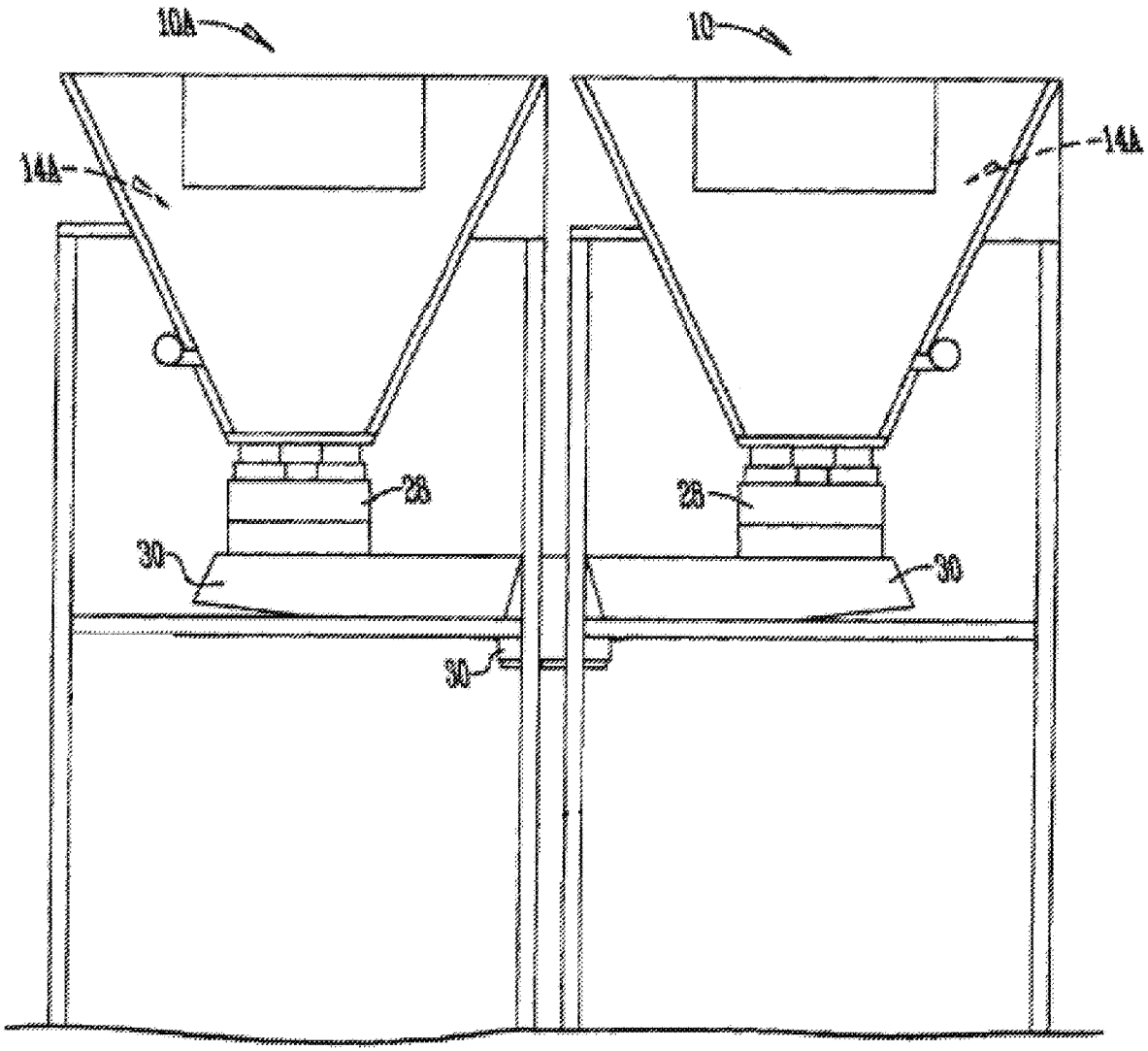
FIG. 3 is a side elevation view of the classification tank of FIG. 1.
Figure 4:
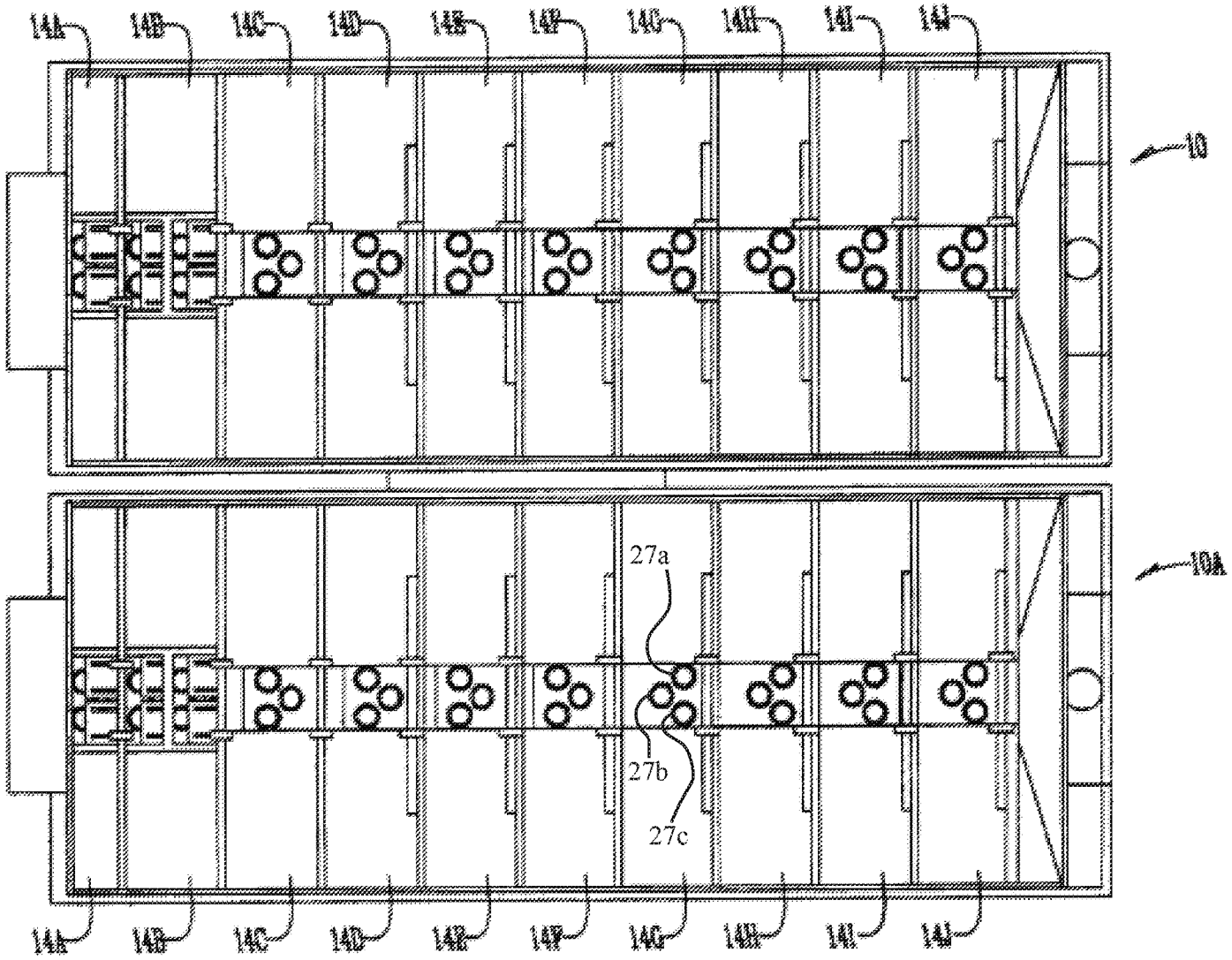
FIG. 4 is a top view of the classification tank of FIG. 1.

Referring to the drawings, wherein like reference numerals designate identical or corresponding parts throughout the several views, a classification tank 10 is illustrated in FIGS. 1-4. Although an additional tank 10A is illustrated, this additional tank 10A is optional and is only included in some alternative embodiments. The control methods described herein do not require an additional tank 10A.

The hydraulic classification tank 10 facilitates the use of the control system (FIG. 5) and methods described herein to perform a number of functions optionally including one or more of the following: tracking the product discharged, performing optimization routines, and determining new settings for each station 14A-J of the tank 10.

Referring to FIGS. 1-4, the tank 10 is supported in an elevated position by a frame 26. Tank 10 has a discharge flume 28 which receives the discharged material through tank discharge pipes 27 from stations 14A-14J. The flumes 28 each discharge into a trough 30 where they are then conveyed by devices 34, 36 (e.g., conveyors, flumes, conduits, pipes, etc.) to one or more devices 32 (see FIG. 2) such as conveyors, dewatering screws, screens, etc. In some embodiments, the tank generally operates at least partially as described in U.S. Pat. No. 6,311,847, hereby incorporated herein by reference.

Figure 5:
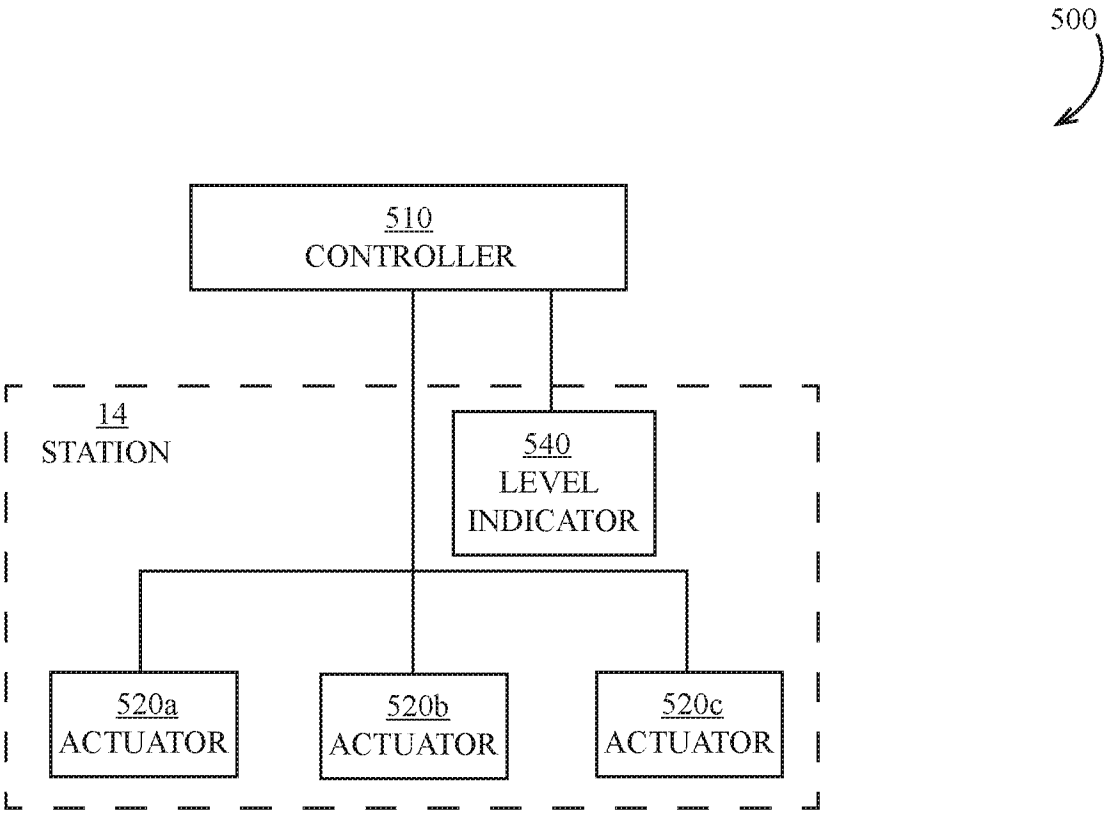
FIG. 5 is a schematic illustration of an embodiment of a classification tank control system.

Referring to FIG. 5, a control system 500 is illustrated for modifying the product discharged by the tank 10. A controller 510 is in data communication (e.g., electrical, electronic, wireless, etc.) with a plurality of actuators 520 (e.g., hydraulic actuators, pneumatic actuators, solenoid-operated actuators, valves, solenoid valves, dart valves, etc.). Each actuator 520 is optionally configured to selectively open or close an individual discharge pipe 27 (e.g., one of discharge pipes 27*a*, 27*b*, 27*c*) at a given station 14 such that product at that station is supplied to the associated product output.

For example, the discharge pipes 27*a* from each station may feed a first channel in the flume 28 whose contents are transferred to storage or processing as a first product (which may be referred to herein as "Product A"), the discharge pipes 27*b* from each station may feed a second channel in the flume 28 whose contents are transferred to storage or processing as a second product (which may be referred to herein as "Product B"), and the discharge pipes 27*c* from each station may feed a third channel in the flume 28 which is transferred for disposal or reuse (which may be referred to herein as "Waste"). In some embodiments, a level indicator 540 (e.g., a turning blade or other device) is provided at each station 14; the level indicator optionally generates a signal when one of the stations should be opened to release a quantity of material at the station (e.g., due to the material at that station rising to a threshold height or other threshold), and the controller 510 determines which of the three discharge pipes 27 to open at the station in order to create a desired product or products. It should be appreciated that the density (or other characteristic) of material varies across the stations, for example in embodiments where the material is introduced with an initial horizontal velocity to an inlet end of the tank 10, causing denser material (e.g., coarse material) to be deposited at the inlet end and less dense (e.g., fine) material to be deposited at the end opposite the inlet end.

Figure 6:
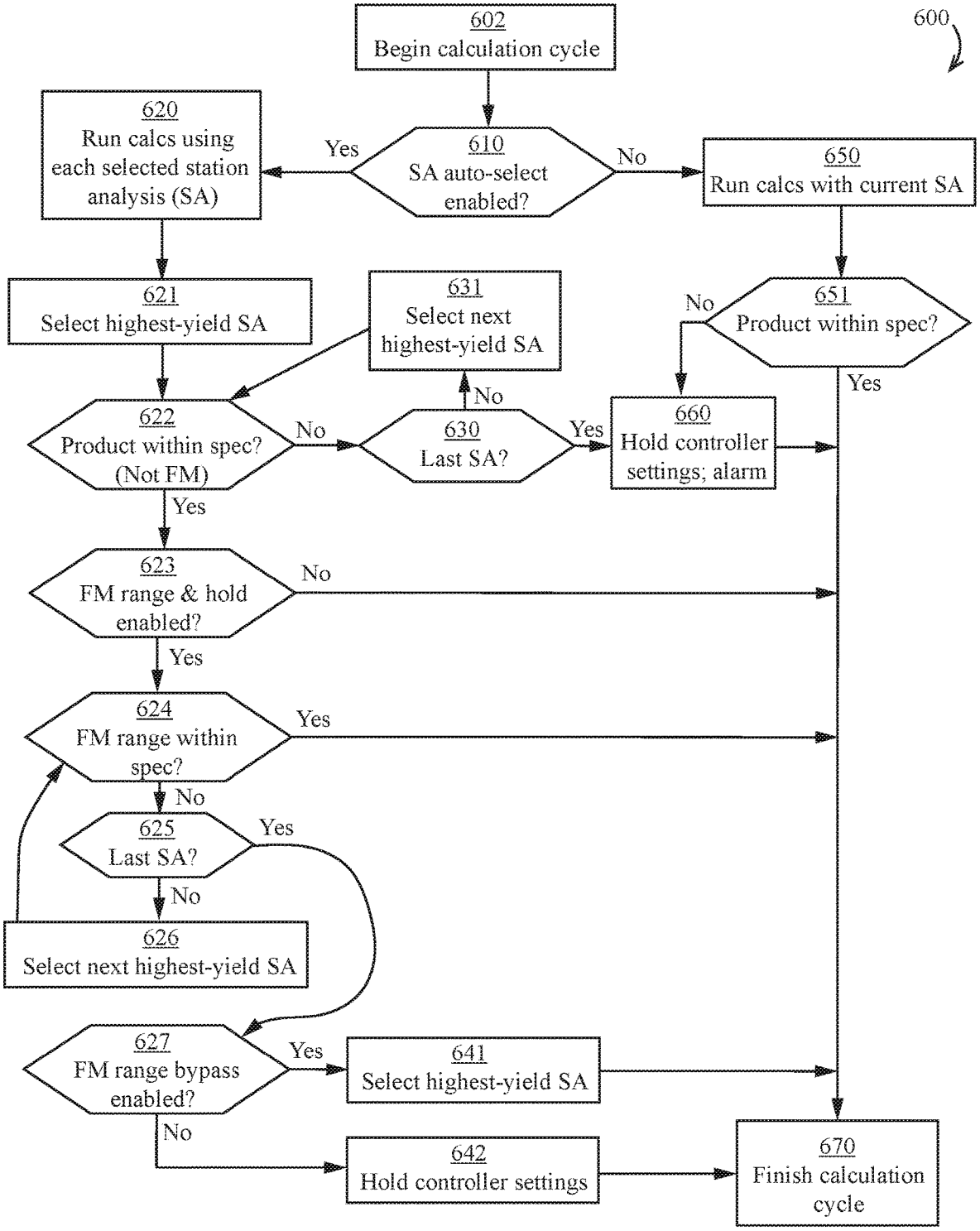
FIG. 6 is a schematic illustration of an embodiment of a process for operating a classification tank.

Referring to FIG. 6, a process 600 for operating the classifying system 500 is illustrated. Prior to the process 600, one or more calibration routines are performed to generate one or more station analyses (e.g., calibrations). Each station analysis associates the relative contribution (in time units or percentage, etc.) each station 14 is discharged to a given product with the resulting product specification (e.g., product size distribution or other criterion).

At step 602, the controller 510 begins a new calculation cycle (e.g., during operation of the system 500). At step 610, the controller 510 determines whether a station analysis auto-select mode has been enabled (e.g., enabled using a user interface in data communication with the controller 510).

If at step 610 the station analysis auto-select mode is not enabled, then at step 650 the controller runs calculations using the currently (e.g., previously) selected station analysis to determine an amount of time (e.g., percentage of total time) to open each individual discharge pipe 27 (e.g., using actuators 520) at each station 14 in order to create one or more products (e.g., product A and/or B). At step 651, the controller 510 determines (e.g., estimates, calculates) based on the current station analysis whether one or more products (e.g., product A and/or B) will be within a desired specification (e.g., entered using a user interface) based on the current station analysis. If at step 651 the product is determined to be within specification, then the controller 510 finishes the calculation cycle at step 670. If at step 651 the product is determined not to be within specification, then the controller 510 retains the current controller settings (e.g., in order to open each discharge pipe the same amount and/or percentage of time during operation) and optionally generates an alarm at step 660 and then completes the calculation cycle at step 670.

If at step 610 the station analysis auto-select mode is enabled, then at step 620 the controller 510 runs a plurality of calculations using a plurality of station analyses (e.g., a subset of available station analyses selected by the user and/or available based on whether a given station analysis has been calibrated) in order to generate one or more products. Each calculation of step 610 optionally generates an estimated amount of waste (e.g., product discharged to Waste) associated with each station analysis. At step 621, the controller 510 selects the highest-yield station analysis (e.g., the station analysis generating the least amount of waste).

At step 622, the controller 510 determines (e.g., estimates, predicts, etc.) whether the product resulting from the currently selected station analysis would result in a product within specification (e.g., a desired and/or preselected specification stored in memory). In some embodiments, the specification consulted at step 622 optionally does not include (e.g., directly include) the fineness modulus of the product. If at step 622 the product is not in specification, then at step 630 the controller determines if the referenced station analysis is the last available station analysis. If not, then at step 631 the controller 510 selects the next highest-yield station analysis and then repeats step 622 with the newly selected station analysis. If at step 630 the selected station analysis is the last available station analysis, then the controller retains the controller settings and optionally generates an alarm at step 660 and then completes the calculation cycle at step 670.

If at step 622 the product is within specification, the resulting selected station analysis may be described as the optimal station analysis, e.g., station analysis generating the highest yield of one or more products (and/or generating the lowest amount of waste) for which the product is within specification.

If at step 622 the product is within specification, then at step 623 the controller 510 optionally determines whether a fineness modulus range-and-hold mode is enabled. If not, then the controller 510 completes the calculation cycle at step 670.

If at step 623 the fineness modulus range-and-hold mode is enabled, then at step 624 the controller 510 optionally determines (e.g., estimates, predicts, etc.) whether the fineness modulus (FM) of the product is within a range defined by a fineness modulus specification. The FM of the product may be defined as the cumulative percentage (divided by 100) of product that would be retained on a series of sieves. If the FM is within specification, then the controller 510 completes the calculation cycle at step 670.

If at step 624 the FM is not within specification, then at step 625 the controller 510 optionally determines whether the referenced station analysis is the last available station analysis. If not, then at step 626 the controller optionally selects the next highest-yield station analysis then returns to step 624.

If at step 625 the referenced station analysis is the last available station analysis, then at step 627 the controller 510 determines whether an FM range bypass mode is enabled. If not, then at step 642 the controller 510 optionally retains the controller settings and optionally generates an alarm before finishing the calculation cycle at step 670. If at step 627 the FM range bypass is enabled, then at step 641 the controller 510 selects the highest-yield station analysis that results in a product within the non-FM specification and finishes the calculation cycle at step 670.

Figure 7:
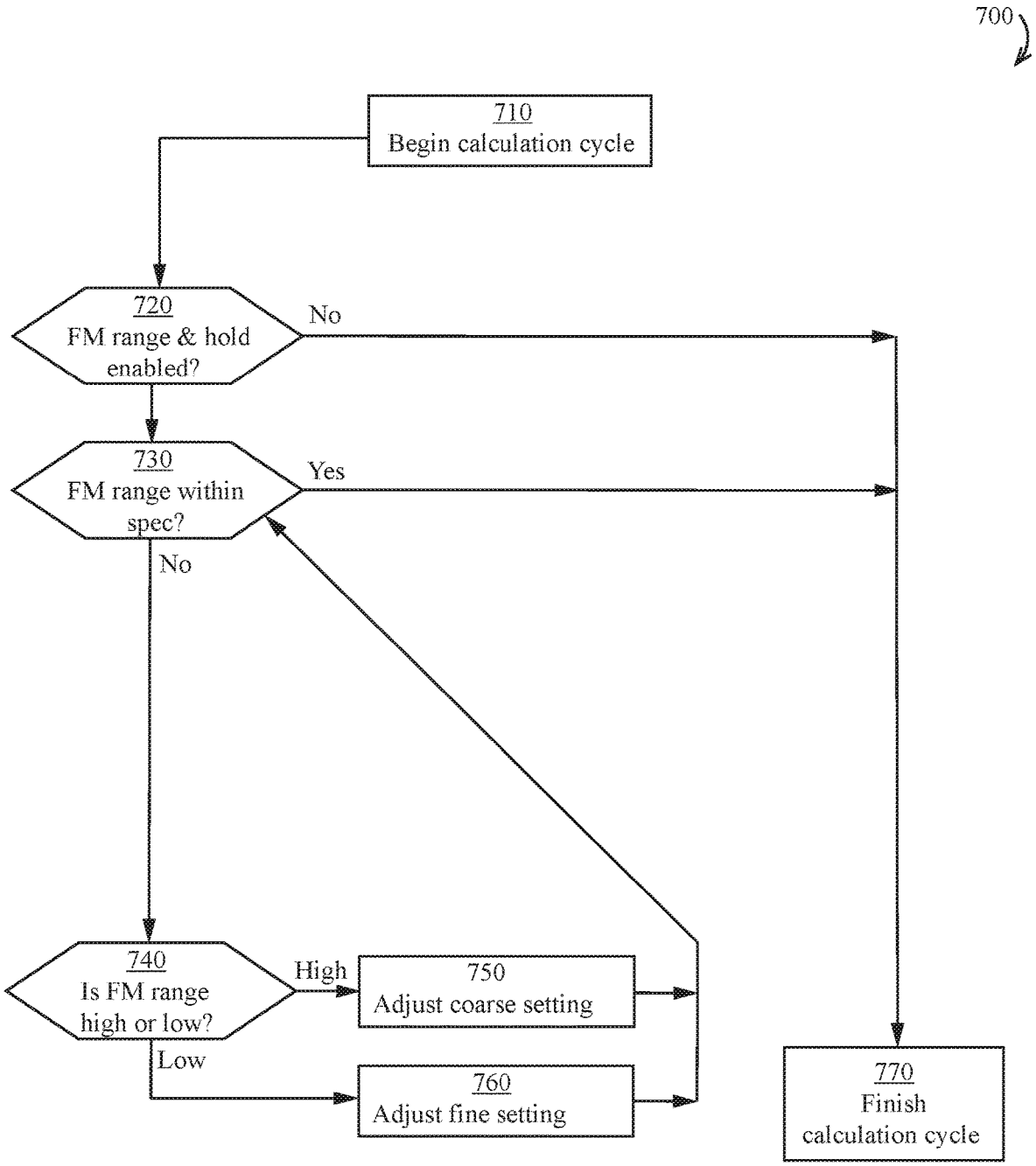
FIG. 7 is a schematic illustration of another embodiment of a process for operating a classification tank.

Referring to FIG. 7, an embodiment of a process 700 for operating the classifying system 500 is illustrated. At step 710, the controller 510 begins a new calculation cycle (e.g., during operation of the system 500). At step 720, the controller 510 optionally determines whether a fineness modulus range-and-hold mode is enabled. If not, then the controller 510 completes the calculation cycle at step 770. If at step 720 the fineness modulus range-and-hold mode is enabled, then at step 730 the controller 510 determines at step 730 whether the fineness modulus (FM) of the product (and/or or a statistical range thereof such as a minimum, maximum, average, etc.) is within a range defined by a fineness modulus specification. If the FM is within specification, then the controller 510 completes the calculation cycle at step 770.

If at step 730 the FM is not within the specification, then at step 740 the controller 510 determines whether the FM is high or low. If the FM is high, then at step 750 the controller makes an operational adjustment (e.g., iterative operational adjustment) to a station on the "coarse" side of the classifier (e.g., the station nearest to the inlet side of the classifier tank) and then determines again if the FM is within the specification. If the FM is low, then at step 760 the controller makes an operational adjustment to a station on the "fine" side of the classifier and then determines again if the FM is within the specification.

In some embodiments, execution of the process embodiments disclosed herein (e.g., processes 600, 700, etc.) results in the actuation of one or more actuators 520 in order to open one or more discharge pipes 27. In some embodiments, one or more discharge pipes 27 are opened and/or closed (e.g., by actuation of one or more actuators 520) based on the outcome of the process embodiments described herein. In some embodiments, an actuator 520 is actuated at a different time or a different length of time due to the execution of one or more processes described herein. In some embodiments, a discharge pipe 27 is open at a different time or a different length of time due to the execution of one or more processes described herein.

It should be appreciated that the controller 510 described herein could comprise one or more computing device. For example, the controller 510 could comprise a user interface on a first device in communication with a second computing device used to perform one or more calculations.

Although various embodiments have been described above, the details and features of the disclosed embodiments are not intended to be limiting, as many variations and modifications will be readily apparent to those of skill in the art. Accordingly, the scope of the present disclosure is intended to be interpreted broadly and to include all variations and modifications within the scope and spirit of the appended claims and their equivalents. For example, any feature described for one embodiment may be used in any other embodiment.

The invention claimed is:

1. A method of operating a classifying tank having a plurality of stations disposed in spaced apart relation along the width of the tank, each station having a plurality of discharge openings for releasing aggregate material to one of at least a first and second destination, the first destination corresponding to a first product and the second destination corresponding to waste, each station having an actuator for selectively opening one or more of the discharge openings at the associated station, the method comprising:

introducing aggregate material to the classifying tank such that one or more characteristics of said aggregate material is different at each of the plurality of stations;

using the actuators, opening and closing one or more discharge openings at each station in order to direct a portion of the aggregate material from each station to one of at least a first and second destination;

executing a plurality of station analyses, each station analysis determining a first actual specification of said first product;

comparing the first actual specification of said first product for each station analysis to a first desired specification;

calculating a plurality of amounts of waste, each amount of waste being associated with one of said plurality of station analyses, said waste not being within said first desired specification;

identifying an acceptable subset of station analyses, the acceptable subset of station analyses being the subset for which the first actual specification is within the first desired specification;

selecting an optimal station analysis, the optimal station analysis being the station analysis within said acceptable subset corresponding to the lowest of said plurality of amounts of waste;

using the actuators, opening and closing one or more discharge openings at each station according to the optimal station analysis; and transferring said waste from said second destination for disposal or reuse.

2. The method of claim 1, further comprising:

determining whether a station analysis auto-select mode is enabled.

3. The method of claim 1, further comprising:

determining that there is no station analysis for which the first actual specification is within the first desired specification; and generating an alarm.

4. The method of claim 1, further comprising:

determining whether an estimated fineness modulus associated with the optimal station analysis is within a fineness modulus specification.

5. The method of claim 4, further comprising:

if said estimated fineness modulus associated with the optimal station analysis is not within a fineness modulus specification, selecting another station analysis.

6. The method of claim 4, further comprising:

if said estimated fineness modulus associated with the optimal station analysis is not within a fineness modulus specification, selecting the station analysis having the next least amount of waste.

7. The method of claim 1, further comprising:

opening and closing one or more discharge openings at each station in order to direct at least a portion of said aggregate material from each station to a third destination corresponding to a second product.

8. The method of claim 7, wherein each station analysis further determines a second actual specification of said second product.

9. The method of claim 8, further comprising:

comparing the second actual specification of said second product for each station analysis to a second desired specification.

10. The method of claim 9, wherein the second actual specification of said second product is further within the second desired specification for each station analysis of the acceptable subset of station analyses.

11. The method of claim 10, further comprising:

determining whether a station analysis auto-select mode is enabled.

12. A method of operating a classifying tank having a plurality of stations disposed in spaced apart relation along the width of the tank and extending from an inlet side to on outlet side of the tank, each station having a plurality of discharge openings for releasing aggregate material to one of at least a first and second destination, the first destination corresponding to a first desired product and the second destination corresponding to waste, each station having an actuator for selectively opening one or more of the discharge openings at the associated station, the method comprising:

calculating a plurality of amounts of waste, each amount of waste being associated with one of said plurality of station analyses, said waste not being within said first desired specification;

transferring said waste from said second destination for disposal or reuse;

introducing aggregate material to the classifying tank such that one or more characteristics of said aggregate material is different at each of the plurality of stations;

using the actuators, opening and closing one or more discharge openings at each station in order to direct a portion of the aggregate material from each station to one of at least a first and second destination;

determining a first estimated fineness modulus of said first product;

determining whether said first estimated fineness modulus of said first product is within a first fineness modulus specification;

if said first estimated fineness modulus is higher than said first fineness modulus specification, making an operational adjustment to one of the plurality of stations, said one of the plurality of stations being the station nearest to the inlet side of the classifying tank comparing the first actual specification of said first product for each station analysis to a first desired specification;

identifying an acceptable subset of station analyses, the acceptable subset of station analyses being the subset for which the first actual specification is within the first desired specification;

selecting an optimal station analysis, the optimal station analysis being the station analysis within said acceptable subset corresponding to the lowest of said plurality of amounts of waste, and using the actuators, opening and closing one or more discharge openings at each station according to the optimal station analysis.

13. The method of claim 12, further comprising:

if said first estimated fineness modulus is lower than said fineness modulus specification, making an operational adjustment to a station farthest from the inlet end classifying tank.

14. The method of claim 13, further comprising:

opening and closing one or more discharge openings at each station in order to direct at least a portion of said aggregate material from each station to a third destination corresponding to a second product.

15. The method of claim 14, further comprising:

determining a second estimated fineness modulus of the second product;

determining whether said second estimated fineness modulus is within a second fineness modulus specification; and if said second estimated fineness modulus is higher than said second fineness modulus specification, making an operational adjustment to a station nearest to the inlet side of the classifying tank.

16. The method of claim 15, further comprising:

if said second estimated fineness modulus is lower than said second fineness modulus specification, making an operational adjustment to a station farthest from the inlet side of the classifying tank.

17. The method of claim 14, wherein each station analysis further determines a second actual specification of said second product.

18. The method of claim 17, further comprising:

comparing the second actual specification of said second product for each station analysis to a second desired specification.

19. The method of claim 18, wherein the second actual specification of said second product is further within the second desired specification for each station analysis of the acceptable subset of station analyses.

* * * * *